US008469216B2

(12) United States Patent
Pils

(10) Patent No.: US 8,469,216 B2
(45) Date of Patent: Jun. 25, 2013

(54) DEVICE FOR UNLOCKING FOLDABLE SIDE WALLS OF BOXES AND CONTAINERS

(75) Inventor: Volker Pils, Weitefeld (DE)

(73) Assignee: Fritz-Schaefer GmbH, Neunkirchen (DE)

( * ) Notice: Subject to any disclaimer, the term of this patent is extended or adjusted under 35 U.S.C. 154(b) by 254 days.

(21) Appl. No.: 12/811,730

(22) PCT Filed: Jan. 3, 2009

(86) PCT No.: PCT/EP2009/000007

§ 371 (c)(1),
(2), (4) Date: Jul. 30, 2010

(87) PCT Pub. No.: WO2009/100799

PCT Pub. Date: Aug. 20, 2009

(65) Prior Publication Data

US 2010/0294757 A1 Nov. 25, 2010

(30) Foreign Application Priority Data

Feb. 11, 2008 (DE) ..... 10 2008 008 579
Dec. 6, 2008 (DE) ..... 10 2008 060 913

(51) Int. Cl.

| | |
|---|---|
| ***B65D 6/00*** | (2006.01) |
| ***B65D 8/14*** | (2006.01) |
| ***B65D 8/04*** | (2006.01) |
| ***B65D 8/18*** | (2006.01) |
| ***B65D 90/02*** | (2006.01) |
| ***B65D 19/00*** | (2006.01) |

(52) U.S. Cl.
USPC ..... 220/7; 220/6; 220/666; 220/4.28; 220/676; 206/600

(58) Field of Classification Search
USPC ..... 220/6, 7, 666, 4.28, 676; 206/600
See application file for complete search history.

(56) References Cited

U.S. PATENT DOCUMENTS

| | | | | |
|---|---|---|---|---|
| 5,362,392 | A * | 11/1994 | Jensen | 210/249 |
| 6,290,081 | B1 | 9/2001 | Merey | |
| 6,293,418 | B1 | 9/2001 | Ogden | |
| 6,843,386 | B2 * | 1/2005 | Raghunathan et al. | 220/7 |
| 7,011,225 | B2 | 3/2006 | Oster | |
| 2005/0098557 | A1 * | 5/2005 | Murakami et al. | 220/7 |
| 2007/0145053 | A1 | 6/2007 | Gil | |

FOREIGN PATENT DOCUMENTS

| | | | |
|---|---|---|---|
| DE | 9113549 | U | 4/1992 |

* cited by examiner

*Primary Examiner* — Anthony Stashick
*Assistant Examiner* — Andrew T Kirsch
(74) *Attorney, Agent, or Firm* — Andrew Wilford

(57) ABSTRACT

The invention relates to a device for unlocking foldable side walls (2 to 5) hinged on the floor (6) of boxes and containers (1), the two opposite end walls (4, 5) thereof being lockable to the adjacent side walls (2, 3) and the unlocking taking place by a lifting motion of a yoke-like adjusting member (13) disposed under spring pretension and guided in recesses of stiffening ribs (11, 12) in the outer surfaces of the end walls (4, 5). The adjusting member (13; 130) is designed having motion-diverting means (16, 17) on the two outside ends thereof, said means diverting vertical motion into a horizontal motion unlocking the side walls when the adjusting member (13) is raised, wherein the unlocking bars (19) of the adjusting member act on spring tab-like locking means (10) of the side walls (4, 5) engaged in the end walls (2, 3) and press them out of engaged seating thereof surrounding the end walls (2, 3).

12 Claims, 4 Drawing Sheets

DEVICE FOR UNLOCKING FOLDABLE SIDE WALLS OF BOXES AND CONTAINERS

CROSS REFERENCE TO RELATED APPLICATIONS

This application is the US-national stage of PCT application PCT/EP2009/000007, filed 3 Jan. 2009, published 20 Aug. 2009 as WO2009/100799, and claiming the priority of German patent application 102008008579.0 itself filed 11 Feb. 2008 and German patent application 102008060913.7 itself filed 6 Dec. 2008.

FIELD OF THE INVENTION

The invention relates to an apparatus for unlatching foldable side walls of boxes or containers, which walls are hinged to a floor, the two opposing end walls of the boxes/containers being latchable to the adjacent side walls, and the unlatching being effected by a lifting motion of a handle actuating element that is spring-loaded to moves in cutouts of reinforcing ribs on outer faces of the end walls.

BACKGROUND OF THE INVENTION

An approach has been made known by DE 91 13 549.4 where spring latches are formed in the upper side sections of the narrow side walls or end walls of a collapsible container. They each comprise a spring tongue that projects into the container to retains the adjacent longitudinal walls in their raised positions. In response to pressure from within, the spring tongues can be pressed outward from their latched position, thereby allowing the longitudinal walls to be folded in onto the floor. Particularly in response to frequent actuation, however, the flexible snap-in latching connection results in breakage, or damage that precludes their use, of the spring latch or snap-in connection. If this happens, the known solution is a replacement spring latch that is inserted into the opening left by the spring latch.

In order to avoid the above-described disadvantages, an approach is known from DE 101 37 328 [U.S. Pat. No. 7,011,225] where a hand-actuatable, one-piece bracket-like handle is provided on each of the outer walls of the end walls, its free ends being provided with latching tabs that interact with latching hooks of the adjacent longitudinal walls. When the latching tabs are engaged with the latching hooks, the container walls are latched in the raised position. When the walls are to be collapsed, the bracket-like handle prestressed by spring tabs is lifted by an upward motion parallel to the end wall. Simultaneous with this action, the latching tabs opposite the latching hooks are lifted upward and the container walls are unlatched. The container walls can then be folded inward.

The disadvantage here, however, is that the container can no longer be latched if the actuating mechanism is damaged, for example if the spring tabs are broken.

OBJECT OF THE INVENTION

The object of the invention is to create an apparatus of the type described above that has greater and improved functional reliability.

SUMMARY OF THE INVENTION

The object is achieved according to the invention by associating motion-redirecting means with each of the two outer ends of the actuating element to redirect vertical motion, when the actuating element is lifted, into a horizontal motion that unlatches the side walls, unlatching links of the actuating element acting on spring-tongue-like latching means of the side walls engaged in the end walls and press them out of their seats in which they clamp the end walls. The invention thus provides a system separation in which latching is always ensured by the latching means that are provided in the side walls adjacent to the end walls and are not dependent on a spring pretension of the bracket-like handle actuating element. Due to the redirection of motion, the actuating element operates only for unlatching, yet does not also serve for latching.

The functionality of the container with foldable walls can always be ensured since latching or engagement of the raised walls is maintained in upright unmodified form even when the one-hand bracket-like handle unlatching mechanism is broken or damaged. However, the unlimited functionality is likewise maintained with unlatching for collapsing the container walls since latching can be overridden individually by hand even without the one-hand unlatching mechanism. All that is required to do this is to hit the end walls from the outside, thereby enabling the unlatching means of the side walls to slide out of their engagement seat. It is possible by simple means to retrofit this advantageous unlatching mechanism.

In one embodiment of the invention, the actuating element has handle ends projecting upward in the lifting direction. Each end extends essentially a full length of the outer face of the end walls and can be displaced upward against the spring force when pulled by hand.

In a preferred embodiment of the invention, the handle ends are each provided with an actuating link running at an angle to the vertical, which link engages complementarily angled U-shaped guides of unlatching elements provided on the left and right ends in the end wall. When the actuating element is actuated by hand, the actuating link received by the U-shaped guide slides upward simultaneously with this lifting motion, or these components are displaced toward each other, by which action the unlatching element is moved horizontally outward parallel to the longitudinal walls overlapping the end walls in one section in a skirt-like fashion. Due to the angled surfaces of the actuating link and of the U-shaped guide of the unlatching element that are displaced toward each other, this engagement corresponding to a mortise/tenon connection, the redirection of motion is effected from the vertical motion of the actuating element to the horizontal motion of the unlatching element directed toward the side wall, such that as a result the latching between the end walls and longitudinal walls is overridden.

To accomplish this according to one proposal of the invention, the unlatching elements are provided with an unlatching link or tongue connected horizontally thereto starting from their U-shaped guide receiving the actuating links, each of which link or tongue acts on the spring tongues that are provided in the corners of the adjoining longitudinal walls, project against the end walls, and engage these walls. To unlatch the end walls, the spring tongues are cammed horizontally outward by the unlatching links or tongues in response to the vertical lifting of the actuating element and of the thus-initiated motion redirection of the unlatching elements. The thus unlatched end walls can then be folded inward onto the floor surface by means of their hinges attached to the floor of the box or container, and the longitudinal walls can then be folded down thereover.

In another embodiment of the invention, the top and bottom link surfaces of the horizontal unlatching link are provided with a spring arm, the spring arms being braced horizontally and vertically on reinforcement ribs within the end wall.

When the bracket-like handle actuating element is released, the spring arms that are molded on in the transition region between the U-shaped guide of the unlatching element and the unlatching link automatically return the unlatching element with the unlatching link to the starting position before unlatching due to the resetting forces created by elastic deformation of the spring arms during prior vertical actuation of the actuating element.

An alternative embodiment of the above-described, multipiece, one-hand unlatching mechanism uses a one-piece, one-hand handle unlatching mechanism, in which according to the invention the handle ends of the bracket-like handle actuating element are formed unitarily with respective unlatching links that extend at an angle to the horizontal toward the spring tongues of the longitudinal walls. The angled unlatching links or tongues can be directly molded onto the free ends of the actuating element by injection molding during the production process.

In order to unlatch the spring tongues projecting toward the end walls, angled cam faces are associated with the unlatching links above the bracket-like handle ends, on which faces the unlatching links are forcibly guided in response to a vertical lifting motion of the bracket-like handle actuating element and redirect the vertical motion into a horizontal motion, in each case toward the spring tongues or side walls to be acted upon.

BRIEF DESCRIPTION OF THE DRAWING

Additional features and details of the invention are described in the following description of embodiments of the invention illustrated in the drawings. Therein.

DETAILED DESCRIPTION

Figure 1:
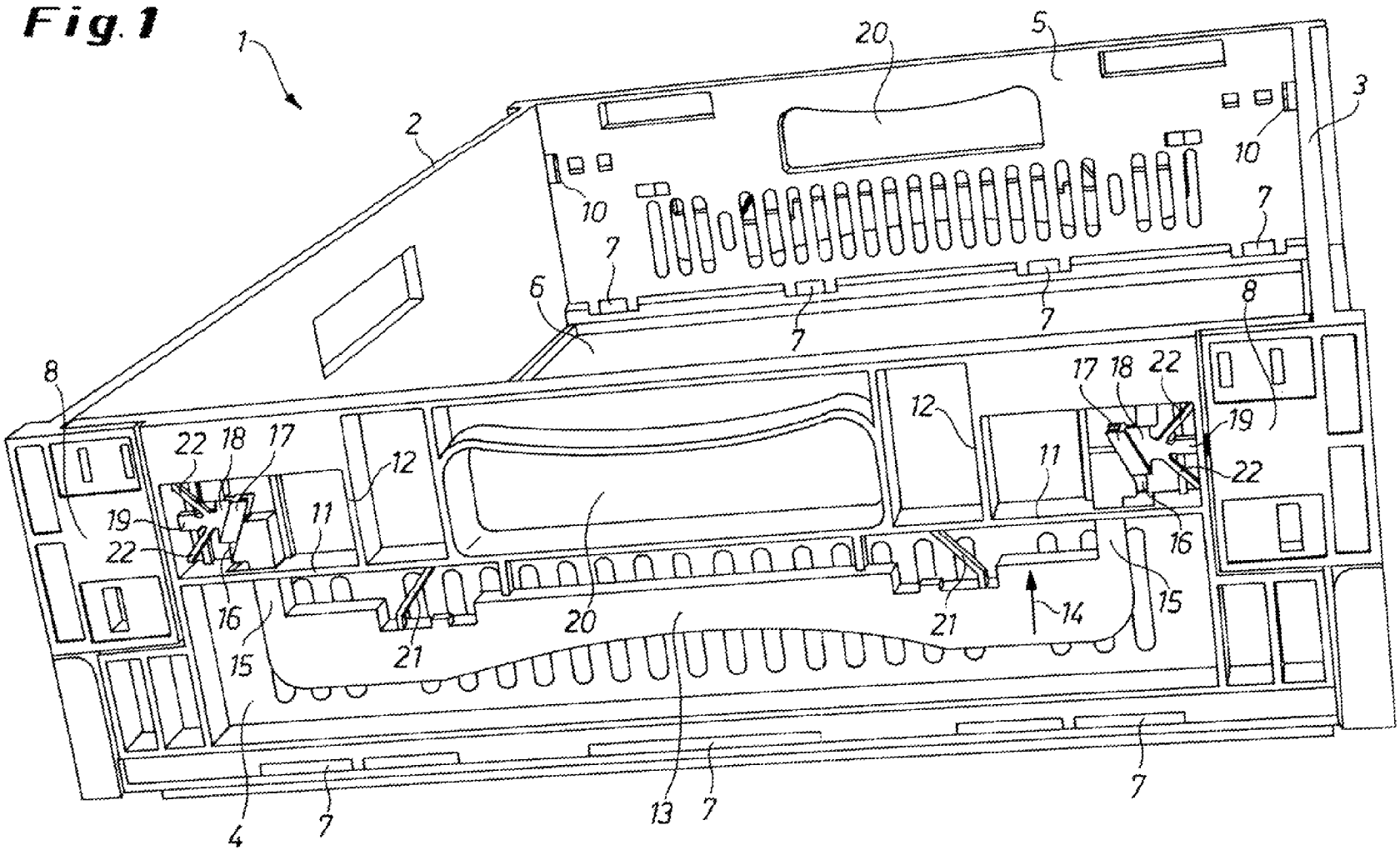
FIG. 1 is an overall perspective view of a container with erected and latched side walls each having a multipart, one-hand bracket-like handle unlatching mechanism on the outside at the front end wall and back end wall.
Figure 2:
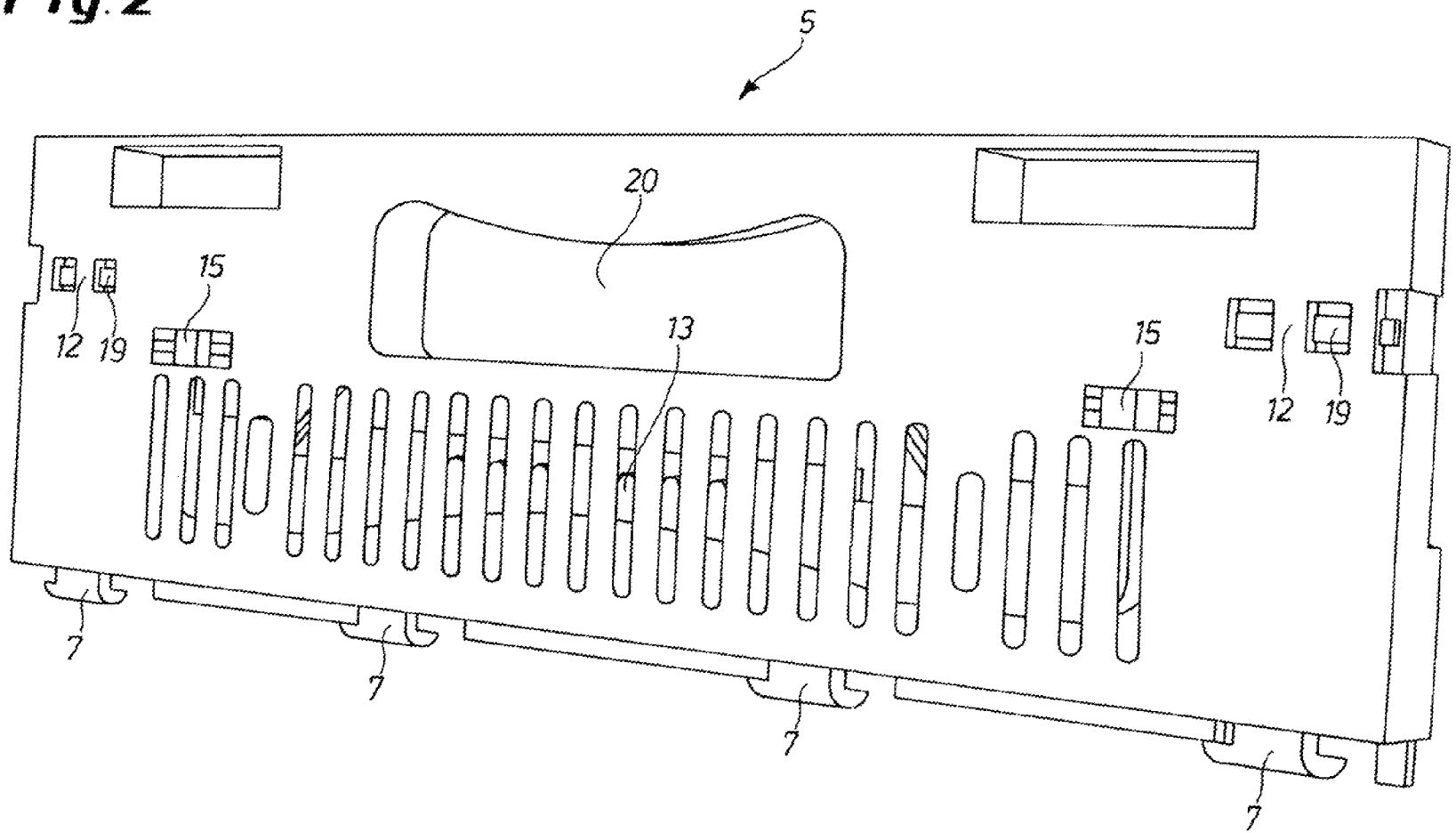
FIG. 2 is a detail of an end wall of the container of FIG. 1 as viewed from inside the container.

FIG. 1 illustrates a container 1 composed of four side walls 2 through 5. Both the two longitudinal walls 2 and 3 and the two end wall 4, 5 can be folded inward onto a container floor 6. To this end, hinges 7 are molded at the bottom edges of the end walls 4 and 5 (see FIG. 2) so these end walls 4 and 5 can be fitted to hinge fittings in the container floor 6. Longitudinal walls 2 and 3 are also provided at their bottom edges with similar unillustrated hinges fit into complementary hinge fittings of the container floor 6. In this case, the hinges of the longitudinal walls 2 and 3 are placed higher than the hinges 7 of the end walls 4 and 5 to allow the longitudinal walls 2 and 3 to be swung down onto the end walls 4 and 5 that were previously folded down onto the container floor 6.

Figure 3:
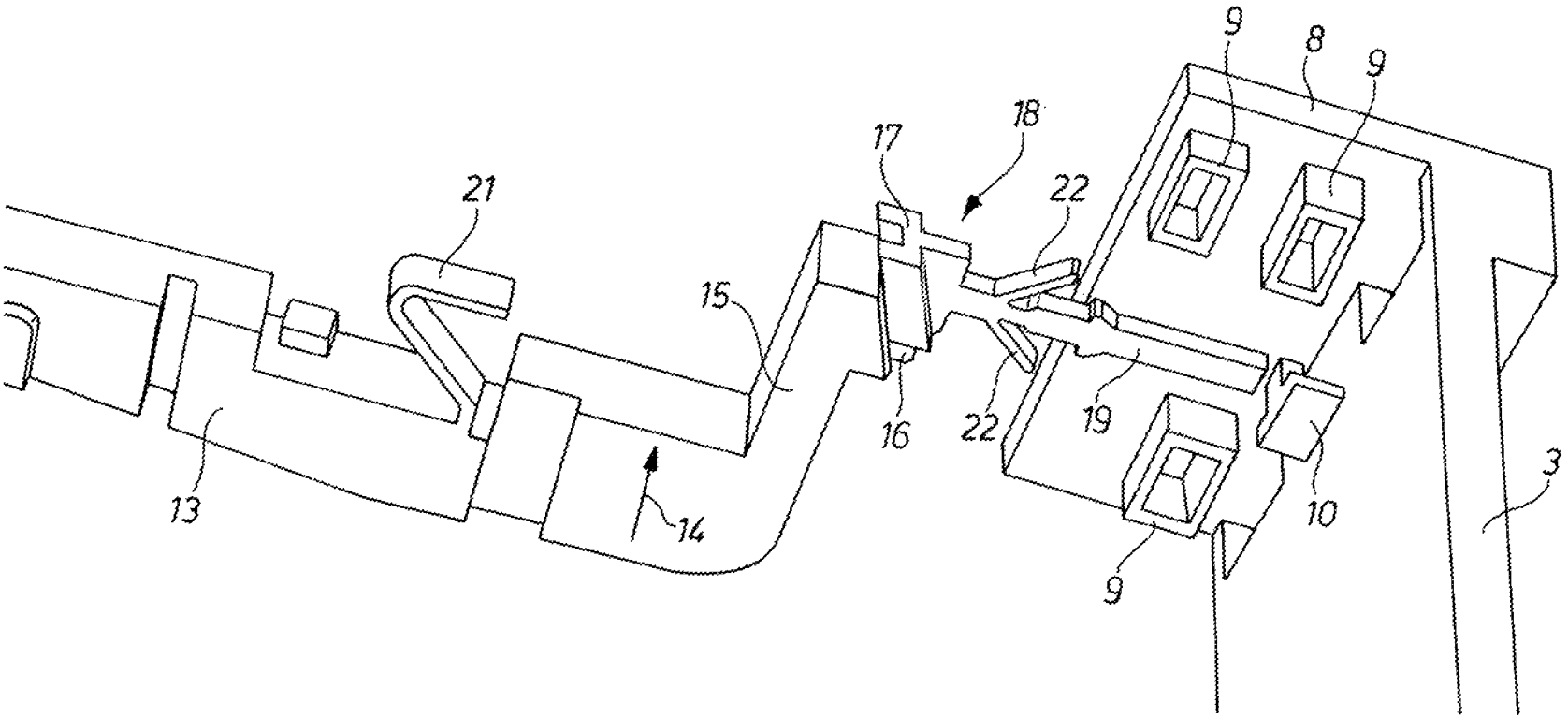
FIG. 3 is a perspective partial view illustrating an end of the multipart, one-hand bracket-like handle unlatching mechanism, shown without the end wall, as viewed from inside the container.

The corners of the longitudinal walls 2 and 3 are each provided with a skirt-like flange 8 that overlaps the respective ends of the end walls 4 and 5. In the upright position, the end walls 4 and 5 bear outward of the container against the flanges 8, where they fit into projections 9 (see FIG. 3) formed on inside faces of the flanges 8 and fitting with respective complementary seats in the end walls 4 and 5.

Spring tongues 10 projecting toward end walls 4 and 5 are formed at the ends of the longitudinal walls 2 and 3 and the flanges 8 and extend from the flanges 8 or the longitudinal walls 2 and 3. When the end walls 4 and 5 are opened up or swung up, they are automatically latched by the consequently snapping-in spring tongues 10 to the longitudinal walls 2 and 3, or to their flanges 8.

The outer face of each end wall 4 and 5 is provided with horizontally projecting reinforcement ribs 11, vertically projecting reinforcement ribs 12, and an arcuate actuating element 13 formed as a handle. This actuating element 13, which extends essentially a full length of the end walls 4 and 5 between the flanges 8, has vertically upwardly projecting ends 15 that are received and retained in cutouts of the horizontal reinforcement ribs 11, and are also guided for sliding in the direction of the arrow 14, that is upward.

In the unlatching process, that is to collapse the end walls 4 and 5 onto the container floor 6, the actuating element 13 is lifted by gripping with the hands such that actuating ridges 16 received by respective U-shaped guides 17 slide upward and simultaneously cam the unlatching elements 18 with unlatching links 19 horizontally outward toward the spring tongues 10, with the result that the spring tongues 10 are pressed outward and the end walls 4 and 5 are unlatched. When the actuating elements 13 are released, they are pressed here by the resetting force of prestressed spring tabs 21 downward and thus move automatically into their starting positions. This action is done by unitary spring arms 22 above and below the unlatching elements 18 and bearing against the vertical reinforcement ribs 12 and by spring tabs 21 of the actuating element 13, for automatic return of the unlatching links 19 with the result that the end walls 4 and 5 automatically snap into the latching connection with spring tongues 10 when they are swung up or raised.

Figure 4:
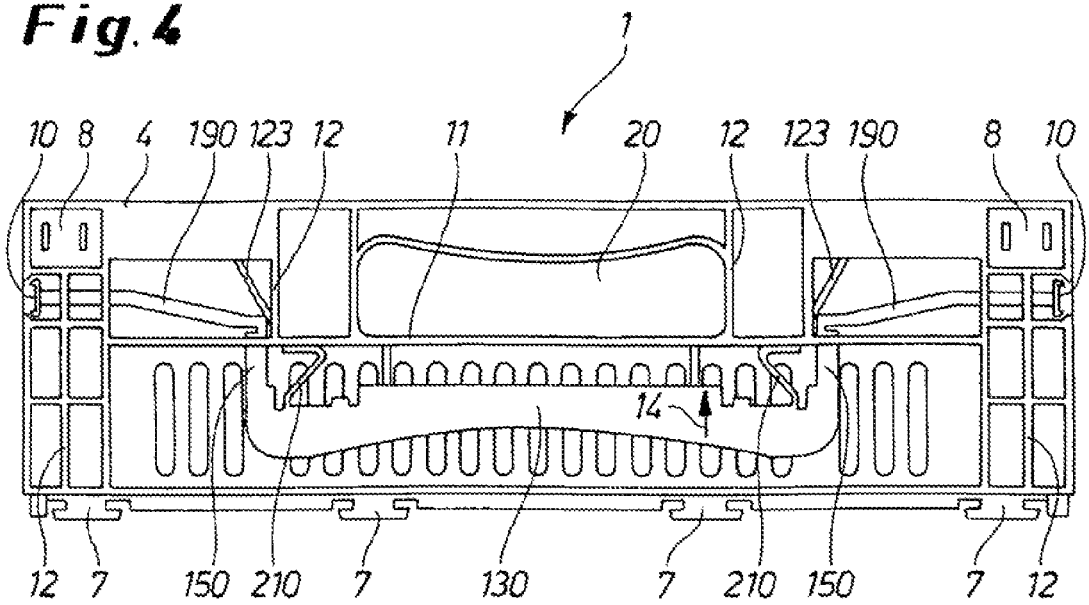
FIG. 4 shows an end wall of a container with a one-piece, one-hand handle unlatching mechanism.
Figure 5:
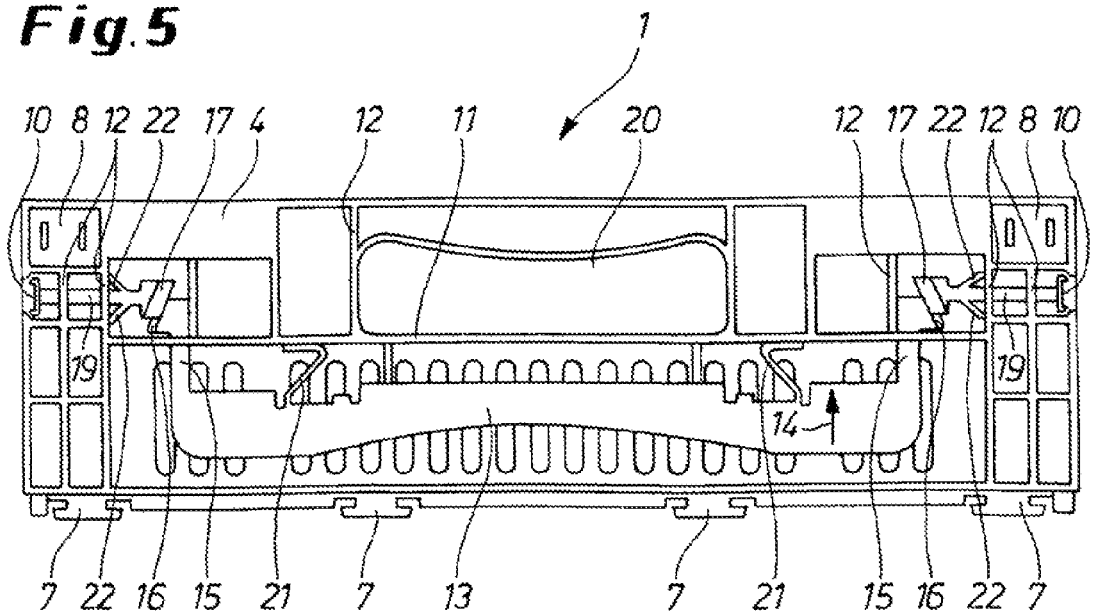
FIG. 5 shows an end wall of the container of FIG. 1 as viewed from outside.

In contrast to the multipart unlatching mechanism described above, FIG. 4 illustrates a one-piece or one-piece unlatching mechanism.

As is the case with the actuating element 13, an actuating element 130 here with its upwardly projecting handle ends 150 is received and retained in cutouts of the horizontal reinforcement ribs 11, and also guided therein in the direction 14. The handle ends 150 of the actuating element 130 are provided with one-piece unlatching links 190 extending horizontally at an angle toward the spring tongues 10. Angled cam faces 123 are associated with the unlatching links 190 between reinforcement ribs on the outside of the end walls 4 and 5.

Furthermore, the actuating element 130 is also provided with spring tabs 210 on the left and right ends of its top link surface.

In order to unlatch and fold down the end walls 4 and 5, the actuating element 130 is lifted upward to press the spring tabs 210 against one of the horizontal reinforcement ribs 11 and be prestressed with the result that a resetting force is created. When the actuating element 130 is lifted, the unitary unlatching links 190 are calmed by the faces 123 horizontally against the spring tongues 10, thereby overriding the latching of the end walls 4 and 5 to the longitudinal walls 2 and 3.

As soon as manual force is no longer being exerted on the actuating element 130, the spring tabs 210 release their tension and press the actuating element 130 back into the starting position. The spring tongues 10, which were also prestressed during the unlatching process, also release their tension, and thus automatically reoccupy their latching position.

The invention claimed is:

1. A box comprising:

a horizontal floor having side and end edges;

respective side and end walls at the side and end edges;

respective hinges pivoting each of the walls to the respective edge for movement between an erect position extending upward from the floor and a stowed position with the walls lying atop one another atop the floor;

respective spring tongues projecting from ends of the side walls and engageable with the end walls in the erect positions of the walls to hold the walls in the erect positions;

a respective actuating element vertically shiftable on an outer face of each of the end walls between an upper position and a lower position;

respective links horizontally shiftable on the outer face of each of the end walls and outwardly engageable with the tongues to press same outward out of engagement with the end walls in the erect positions of the walls;

respective pairs of interengaging angled cam formations on ends of the actuating elements and on the links of the respective end wall for redirecting motion and pushing the links into the outer position when the respective actuating elements are moved into the upper positions; and spring means for urging the links inward and away from the respective tongues.

2. The box defined in claim 1, wherein one of the cam formations is an angled ridge and the other of the cam formations is a U-section guide in which the respective ridge can slide.

3. The box defined in claim 1, wherein the end walls have reinforcing ribs formed with holes in which the links and actuating elements are guided.

4. The box defined in claim 3, further comprising spring means for urging the actuating elements into the lower positions.

5. The box defined in claim 4 wherein the spring means is a spring finger bearing on one of the reinforcing ribs and unitarily formed of plastic with the respective actuating element.

6. The box defined in claim 3, wherein the spring means is at least a spring finger bearing on one of the reinforcing ribs and unitarily formed of plastic with the respective link.

7. The box defined in claim 1 wherein the spring means is a respective pair of symmetrical spring fingers bearing on one of the reinforcing ribs and unitarily formed of plastic with each of the links.

8. The box defined in claim 2 wherein each ridge has a straight angled face and each U-section cam guide has a complementarily angled straight angled face, the angled faces sliding on each other to cam out the links upward movement of the respective actuating elements.

9. The box defined in claim 2 wherein the ribs include vertical ribs and horizontal ribs, some of the vertical ribs being formed with horizontally aligned cutouts complementary to and receiving the links for purely horizontal movement.

10. The box defined in claim 9 wherein each of the actuating elements is shiftable vertically between two of the horizontal ribs of the respective end wall.

11. The box defined in claim 10 wherein each of the actuating elements is generally U-shaped with its ends projecting upward through a vertically throughgoing hole in one of the respective horizontal ribs, each end being connected above the respective one horizontal rib by the respective coupling means to the respective link.

12. The box defined in claim 8 wherein the angled faces are both substantially planar and both extend substantially perpendicular to the respective end wall.

* * * * *